US011455935B2

(12) United States Patent
Sohn et al.

(10) Patent No.: US 11,455,935 B2
(45) Date of Patent: Sep. 27, 2022

(54) DISPLAY DEVICE AND METHOD OF DRIVING THE SAME

(71) Applicant: Samsung Display Co., Ltd., Yongin-Si (KR)

(72) Inventors: Young Soo Sohn, Yongin-si (KR); Jong Man Kim, Yongin-si (KR); Sung Mo Yang, Yongin-si (KR); Seung Young Choi, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/197,982

(22) Filed: Mar. 10, 2021

(65) Prior Publication Data

US 2022/0044619 A1 Feb. 10, 2022

(30) Foreign Application Priority Data

Aug. 6, 2020 (KR) ..... 10-2020-0098694

(51) Int. Cl.
*G09G 3/20* (2006.01)

(52) U.S. Cl.
CPC ... *G09G 3/2092* (2013.01); *G09G 2300/0842* (2013.01); *G09G 2310/08* (2013.01); *G09G 2320/0233* (2013.01); *G09G 2320/043* (2013.01); *G09G 2320/048* (2013.01)

(58) Field of Classification Search
CPC ..... G09G 3/3208; G09G 2320/043; G09G 2320/044; G09G 2320/045; G09G 2320/046; G09G 2320/048
See application file for complete search history.

(56) References Cited

U.S. PATENT DOCUMENTS

| | | | | |
|---|---|---|---|---|
| 10,262,582 | B2 * | 4/2019 | Han | G09G 3/3208 |
| 10,360,828 | B2 * | 7/2019 | Pyo | G09G 3/2011 |
| 2016/0379550 | A1 * | 12/2016 | Jiang | G09G 3/3208 345/520 |
| 2017/0213493 | A1 * | 7/2017 | Han | G09G 3/3208 |

FOREIGN PATENT DOCUMENTS

| | | | |
|---|---|---|---|
| KR | 10-2015-0034948 | A | 4/2015 |
| KR | 10-2017-0087093 | A | 7/2017 |
| KR | 10-2017-0088452 | A | 8/2017 |

* cited by examiner

*Primary Examiner* — Sepehr Azari
(74) *Attorney, Agent, or Firm* — Innovation Counsel LLP

(57) ABSTRACT

A display device according to an embodiment includes a display panel including a plurality of pixels, and an image sticking compensator configured to generate a second image data by reflecting an age data accumulated in a first image data input from an external source. The image sticking compensator generates the age data by accumulating a deterioration data generated by reflecting a frequency weight corresponding to a determined frequency of a previous frame to an image data of the previous frame after the image data of the previous frame is stored.

18 Claims, 10 Drawing Sheets

DISPLAY DEVICE AND METHOD OF DRIVING THE SAME

CROSS-REFERENCE TO RELATED APPLICATION

This application claims priority to Korean Patent Application No. 10-2020-0098694, filed on Aug. 6, 2020, and all the benefits accruing therefrom under 35 U.S.C. § 119, the content of which in its entirety is herein incorporated by reference.

BACKGROUND

1. Field

The present disclosure relates to a display device and a method of driving the same. More particularly, the present disclosure relates to a display device to improve image quality by compensating deterioration of a light emitting element by reflecting a change of an operation frequency.

2. Description of the Related Art

Among display devices, a light emitting display device includes a driving transistor, a capacitor, a light emitting element, and the like. In the light emitting display device, deterioration (hereinafter, deterioration pixel of a pixel) of the light emitting element or the driving transistor may occur due to use.

When the deterioration of the pixel occurs, the display device may not display an image having a desired luminance, and an image sticking may occur on a display panel. Accordingly, the light emitting display device removes an image sticking by accumulating age for each pixel using an image sticking compensation method and compensating for deterioration for each pixel based on the age.

SUMMARY

The present disclosure provides a display device in which an image sticking is improved by compensating for deterioration of a light emitting element by reflecting a change of an operation frequency.

A display device according to an embodiment of the disclosure includes a display panel including a plurality of pixels, and an image sticking compensator configured to generate a second image data by reflecting an age data accumulated in a first image data input from an external. The image sticking compensator generates the age data by accumulating a deterioration data generated by reflecting a frequency weight corresponding to a determined frequency of a previous frame to an image data of the previous frame after the image data of the previous frame is stored.

The image data of the previous frame may be a scaled first image data provided to the previous frame.

The display device may further include a gate driver configured to provide a scan signal to the display panel through a plurality of gate lines, a data driver configured to provide a data signal corresponding to the second image data to the display panel through a plurality of data lines, and a timing controller configured to control driving of the gate driver and the data driver, and the timing controller may determine a frequency of the previous frame and calculate the frequency weight by reflecting the determined frequency.

The image sticking compensator may include a scaling ratio calculator configured to calculate a scaling ratio of the display panel.

The image sticking compensator may generate the scaled first image data by calculating the scaling ratio and the first image data.

The image sticking compensator may include an age data generator configured to generate the age data based on the scaled first image data, and a memory configured to store the accumulated age data and image data of the previous frame.

The memory may include a first memory configured to store the accumulated age data, and a second memory configured to store the image data of the previous frame.

The age data generator may generate the deterioration data by multiplying the image data of the previous frame by the frequency weight, and generate an age data accumulated up to the previous frame by reflecting the accumulated age data on the deterioration data.

The image sticking compensator may output the second image data based on the age data which is accumulated up to the previous frame and the scaled first image data.

The age data generator may update the age data of the previous frame in the first memory.

A display device according to an embodiment of the disclosure includes a display panel including a plurality of pixels, a scaling ratio calculator configured to calculate a scaling ratio of the display panel, a luminance corrector configured to generate a scaled first image data by calculating a first image data and the scaling ratio, an age data generator configured to generate an age data based on the scaled first image data, a memory configured to store the age data and the scaled first image data of a previous frame, a compensator configured to output a second image data based on the scaled first image data and the age data, a gate driver configured to provide a scan signal to the display panel through a plurality of gate lines, a data driver configured to provide a data signal corresponding to the second image data to the display panel through a plurality of data lines, and a timing controller configured to control driving of the gate driver and the data driver. The age data generator generates an age data accumulated up to the previous frame by calculating a deterioration data of one frame to which a frequency weight is applied to a grayscale data of one frame based on the scaled first image data, and a previously accumulated age data.

The memory may include a first memory configured to store the previously accumulated age data, and a second memory configured to store the scaled first image data.

The previously accumulated age data may be the age data accumulated up to a previous frame of the previous frame.

The age data generator may generate the deterioration data by multiplying the scaled first image data of the one frame by the frequency weight, and generate the age data accumulated up to the previous frame by reflecting the previously accumulated age data to the deterioration data.

The compensator may output the second image data based on the age data accumulated up to the previous frame and the scaled first image data.

A method of driving a display device according to an embodiment of the disclosure includes determining a frequency after data of a previous frame is stored, calculating a frequency weight based on the determined frequency, receiving a first image data, generating a scaled first image data by reflecting a scaling ratio on the first image data, generating a frame deterioration data based on the scaled first image data, and storing an age data by accumulating the deterioration data, and distinguishing and storing the scaled first image data of the previous frame.

The method may further include generating an age data which is accumulated up to the previous frame based on the frequency weight, the scaled first image data of the previous frame, and the accumulated age data.

The accumulated age data may be an age data which is accumulated up to a previous frame of the previous frame.

The method may further include updating and storing the age data of the previous frame.

A second image data may be output based on the scaled first image data and the age data up to the previous frame.

According to an embodiment, since the image data of the previous frame may be separately stored and the age data may be generated by reflecting a deterioration weight according to a driving frequency of the previous frame, deterioration of a light emitting element may be compensated and a display device in which an image sticking is improved may be provided.

An effect according to an embodiment is not limited by the contents illustrated above, and more various effects are included in the present specification.

BRIEF DESCRIPTION OF THE DRAWINGS

The above and other features of the disclosure will become more apparent by describing in further detail embodiments thereof with reference to the accompanying drawings, in which.

DETAILED DESCRIPTION

Figure 1:
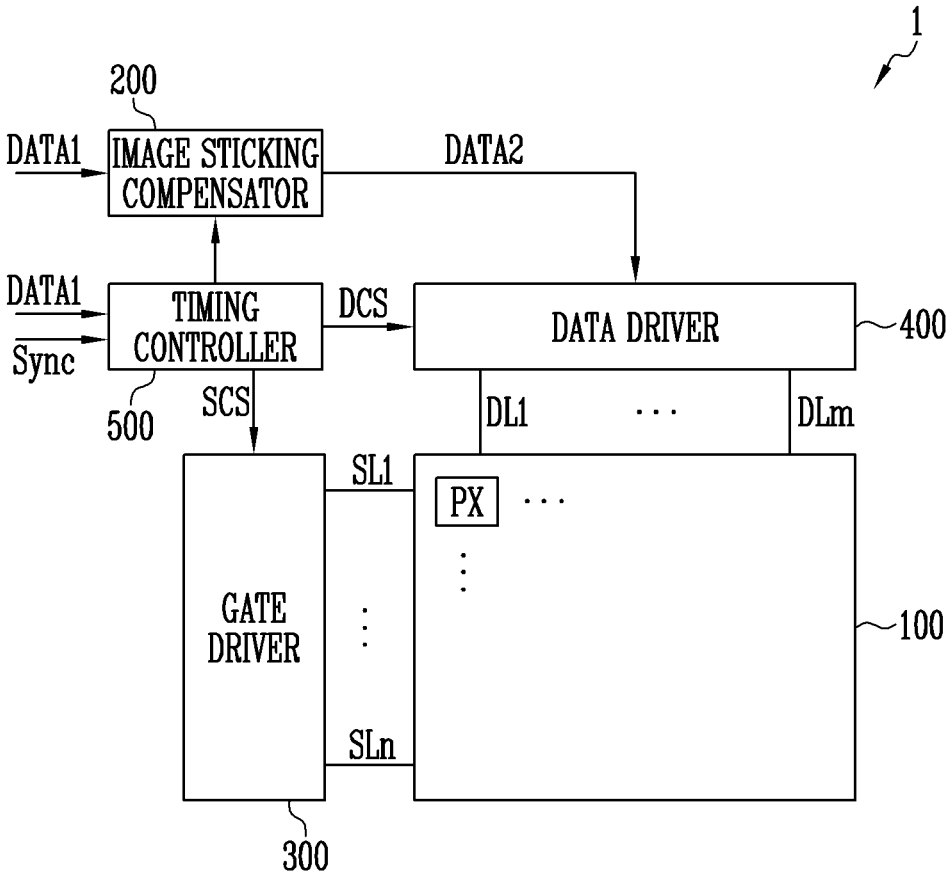
FIG. 1 is a block diagram illustrating a display device according to an embodiment.

The details of other embodiments are included in the detailed description and drawings.

The advantages and features of the disclosure and a method achieving them will become apparent with reference to the embodiments described in detail below with reference to the accompanying drawings. However, the disclosure is not limited to the embodiments described below, and may be embodied in various forms. In the following description, it is assumed that a case in which a part is connected to another part includes a case in which they are electrically connected to each other with another element interposed therebetween as well as a case in which they are directly connected to each other.

In addition, in the drawings, parts which are not related to the disclosure are omitted for clarity of description, and similar parts are denoted by the same reference numerals throughout the specification.

Figure 2:
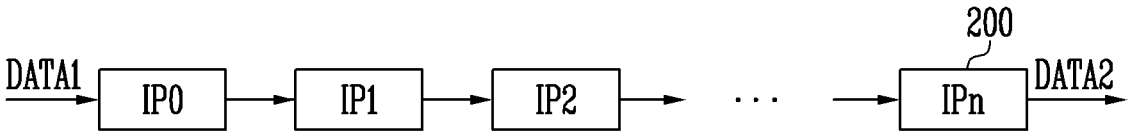
FIG. 2 is a block diagram illustrating a plurality of controllers of the display device according to an embodiment.
Figure 3:
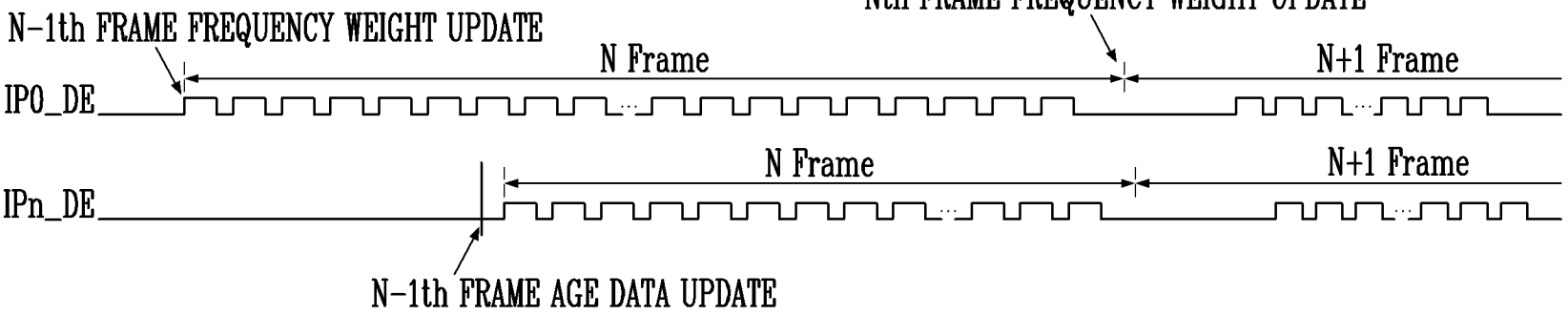
FIG. 3 is an example waveform diagram of a signal applied to the display device according to an embodiment.
Figure 4:
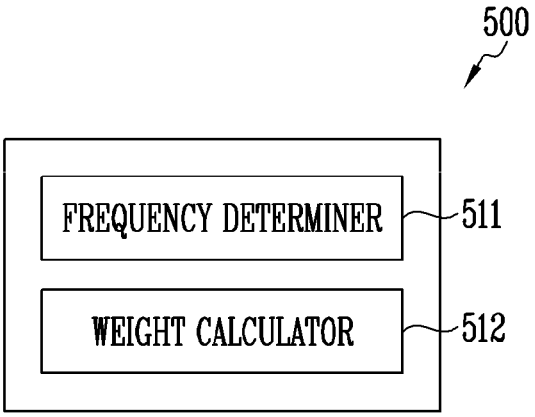
FIG. 4 is a block diagram schematically illustrating a timing controller of the display device according to an embodiment.

FIG. 1 is a block diagram illustrating a display device according to an embodiment, FIG. 2 is a block diagram illustrating a plurality of controllers of the display device according to an embodiment, FIG. 3 is an example waveform diagram of a signal applied to the display device according to an embodiment, and FIG. 4 is a block diagram schematically illustrating a timing controller of the display device according to an embodiment.

First, referring to FIG. 1, the display device 1 according to an embodiment includes a display panel 100, an image sticking compensator 200, a gate driver 300, a data driver 400, and the timing controller 500.

The display device 1 may include an organic light emitting display device, an inorganic light emitting display device, or the like. In addition, the display device 1 may be implemented as a flexible display device, a rollable display device, a curved display device, a transparent display device, a mirror display device, or the like.

The display panel 100 may include a plurality of pixels PX and display an image. Specifically, the display panel 100 may include a pixel PX connected to at least one of a plurality of gate lines SL1 to SLn and at least one of a plurality of data lines DL1 to DLm.

The image sticking compensator 200 receives first image data DATA1 provided from an external source and outputs second image data DATA2 based on age data accumulated up to a previous frame. Here, the age data is generated by reflecting (or calculating) deterioration data of one frame to which a frequency weight is applied to grayscale data of one frame based on scaled first image data DATA1_SR (FIG. 5 and subsequent figures) to previously accumulated age data. The one frame may be a previous frame of a current frame, and the previously accumulated age data may be age data accumulated up to a previous frame of the previous frame.

Figure 5:
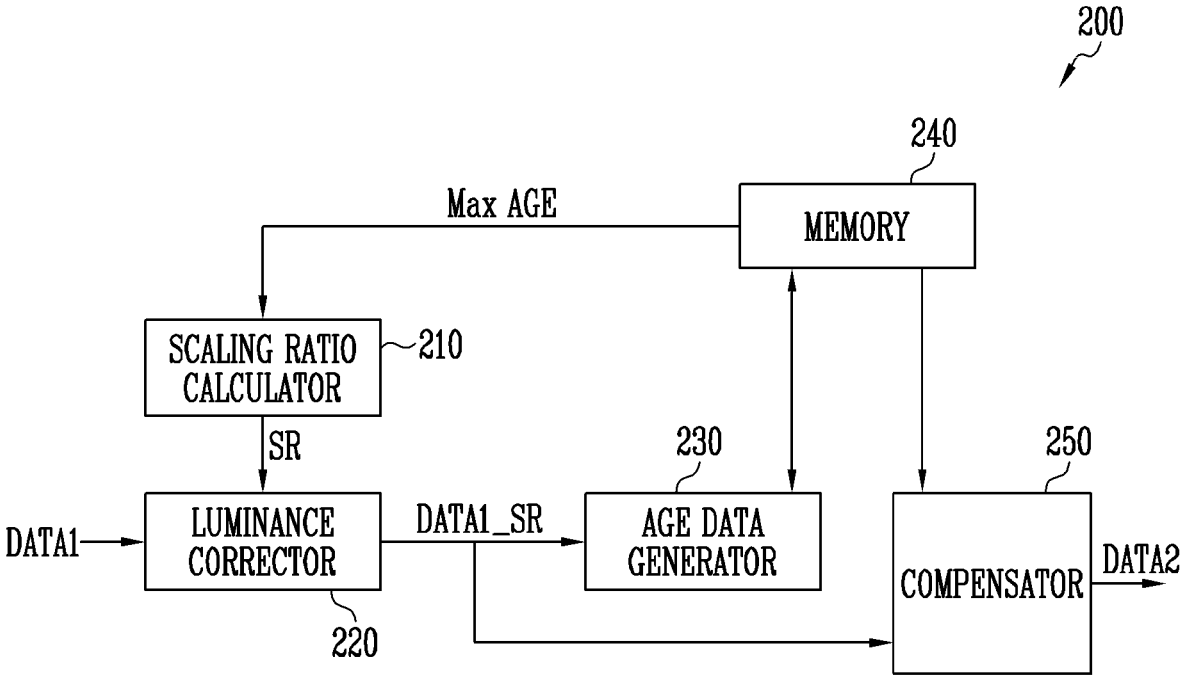
FIG. 5 is a block diagram illustrating an image sticking compensator of the display device according to an embodiment.

The second image data DATA2 is data provided to the data driver 400 to be described later, and is generated by reflecting the age data accumulated up to the previous frame based on the scaled first image data DATA1_SR (FIG. 5 or subsequent figures). Here, the scaled first image data DATA1_SR (FIG. 5 or subsequent figures) may be referred to as image data of the previous frame.

In addition, the image sticking compensator 200 may generate accumulated age data by accumulating grayscale data of each frame based on the first image data DATA1_SR (FIG. 5 or subsequent figures) scaled based on the first image data DATA1. According to an embodiment, the first image data DATA1 may be input image data and may include input grayscale data.

For example, when displaying an image of an n-th frame on the display panel 100, the image sticking compensator 200 may store age data previously accumulated up to an (n-2)-th frame, and deterioration data of one frame based on the scaled first image data DATA1_SR of an (n-1)-th frame. The deterioration data of the one frame may be a value in which a weight according to a frequency of the (n-1)-th frame is reflected on the scaled first image data DATA1_SR of the (n-1)-th frame. In addition, the image sticking compensator 200 may generate the age data accumulated up to the (n-1)-th frame by calculating the age data accumulated up to the (n-2)-th frame and the deterioration data of the (n-1)-th frame.

The image sticking compensator 200 may update and store the age data of the previous frame. The image sticking compensator 200 may output the second image data DATA2 based on the scaled first image data DATA1_SR (FIG. 5 or subsequent figures) and the age data accumulated up to the previous frame.

Meanwhile, in FIG. 1, the image sticking compensator 200 is shown as a separate configuration, but according to an embodiment, the image sticking compensator 200 may be included in the timing controller 500, and the image sticking compensator 200 may be included in the data driver 400.

The accumulated age data may be stored in an internal memory or an external memory. The internal memory may be a separate memory included in the image sticking compensator 200, and the external memory may be a flash memory.

The gate driver 300 provides a scan signal to the pixels PX of the display panel 100 through the plurality of gate lines SL1 to SLn. The gate driver 300 provides the scan signal to the display panel 100 based on a first control signal SCS received from the timing controller 500.

The data driver 400 provides a data signal corresponding to the second image data DATA2 to the pixels PX of the display panel 100 through the plurality of data lines DL1 to DLm. The data driver 400 provides the data signal to the display panel 100 based on a second control signal DCS received from the timing controller 500.

The data driver 400 may include a gamma corrector (not shown) that converts the second image data DATA2 into a voltage corresponding to the data signal. The second image data DATA2 of a grayscale domain may be converted into a data voltage (that is, the data signal) of a voltage domain by the gamma corrector. The gamma corrector may be disposed to be included in the data driver 400 or may be disposed separately from the data driver 400.

The timing controller 500 receives the first image data DATA1 from an external graphic source or the like, and controls driving of the gate driver 300 and the data driver 400. The timing controller 500 may control driving of the image sticking compensator 200.

The timing controller 500 generates a plurality of first control signals SCS and second control signals DCS using a synchronization signal Sync input from an external source, for example, a clock signal CLK, a data enable signal DE, a horizontal synchronization signal Hsync, and a vertical synchronization signal Vsync. In addition, the timing controller 500 may control the gate driver 300 and the data driver 400 by supplying the plurality of generated first control signals SCS and second control signals DCS to the gate driver 300 and the data driver 400, respectively.

Referring to FIG. 2, the timing controller 500 may include a plurality of controllers IP0, IP1, IP2, . . . , and IPn. Each controller may include an optical compensator, a dimming unit, an image sticking compensator, and the like. In the present embodiment, it is assumed that an n-th controller is the image sticking compensator 200.

The first image data DATA1 input to the first controller IP0 may pass through from the second controller IP1 to the image sticking compensator 200 and may be converted into the second image data DATA2.

Referring to FIG. 3, before the data enable signal DE of an Nth frame is applied to the first controller IP0, the timing controller 500 may determine an operation frequency of a previous frame N−1th Frame, and calculate a frequency weight to be provided to the image sticking compensator 200. That is, before the data enable signal DE of the Nth frame is applied to the image sticking compensator 200, the operation frequency of the previous frame N−1th frame may be determined.

Thereafter, the image sticking compensator 200 generates deterioration data of the previous frame N−1th Frame by reflecting the frequency weight of the previous frame N−1th Frame, and updates the age data by reflecting the deterioration data. Thereafter, after the age data is updated, the data enable signal DE may be applied to the image sticking compensator 200. Therefore, the image sticking compensator 200 may compensate for deterioration of the pixel by using the age data reflected up to the operation frequency of the previous frame N−1th Frame. More details will be described later.

Hereinafter, the timing controller 500 capable of calculating the frequency weight is described with reference to FIG. 4.

Referring to FIG. 4, the timing controller 500 includes a frequency determiner 511 and a weight calculator 512. In an embodiment, when an operation frequency of a signal applied to the display device 1 is varied, the variation is to compensate for the image data of the current frame by reflecting the changed frequency.

The frequency determiner 511 receives a synchronization signal Sync and determines a frequency of a frame. Here, the frequency determiner 511 may determine a frequency of a previous frame (an (n-1)-th frame) before an image of an n-th frame is displayed on the display panel 100. In more detail, after data of the previous frame is stored in the memory, the frequency determiner 511 may determine the frequency of the previous frame. The weight calculator 512 calculates the frequency weight by reflecting the determined frequency of the previous frame.

The weight calculator 512 may provide the calculated frequency weight to the image sticking compensator 200. The image sticking compensator 200 may generate the second image data DATA2 by using the frequency weight. A method of generating the second image data DATA2 will be described below.

A signal (and/or data) having the same frequency may be applied to the display device according to an embodiment during a plurality of frame periods, and a signal (and/or data) having different frequencies may be applied to each of the plurality of frames. In this case, even though data of the same grayscale is input for each of the plurality of frames, the deterioration data to be reflected on the age data for each of the plurality of frames may be set differently in correspondence with the frequency change. A difference of the deterioration data according to frequency change will be described below.

Meanwhile, in FIG. 4, the frequency determiner 511 and the weight calculator 512 are included in the timing controller 500, but according to an embodiment, the frequency determiner 511 and the weight calculator 512 may be implemented in a configuration separate from the controller 500. In addition, the frequency determiner 511 and the weight calculator 512 may be included in the image sticking compensator 200 or the data driver 400 respectively, or may be included in the image sticking compensator 200 or the data driver 400 together.

Hereinafter, the image sticking compensator of the display device will be described in detail with reference to FIGS. 5, 6, 7, 8A, 8B, 9A, and 9B.

Figure 6:
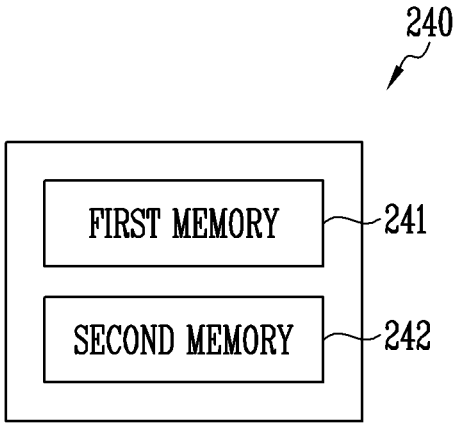
FIG. 6 is a block diagram illustrating a memory of the image sticking compensator of the display device according to an embodiment.
Figure 7:
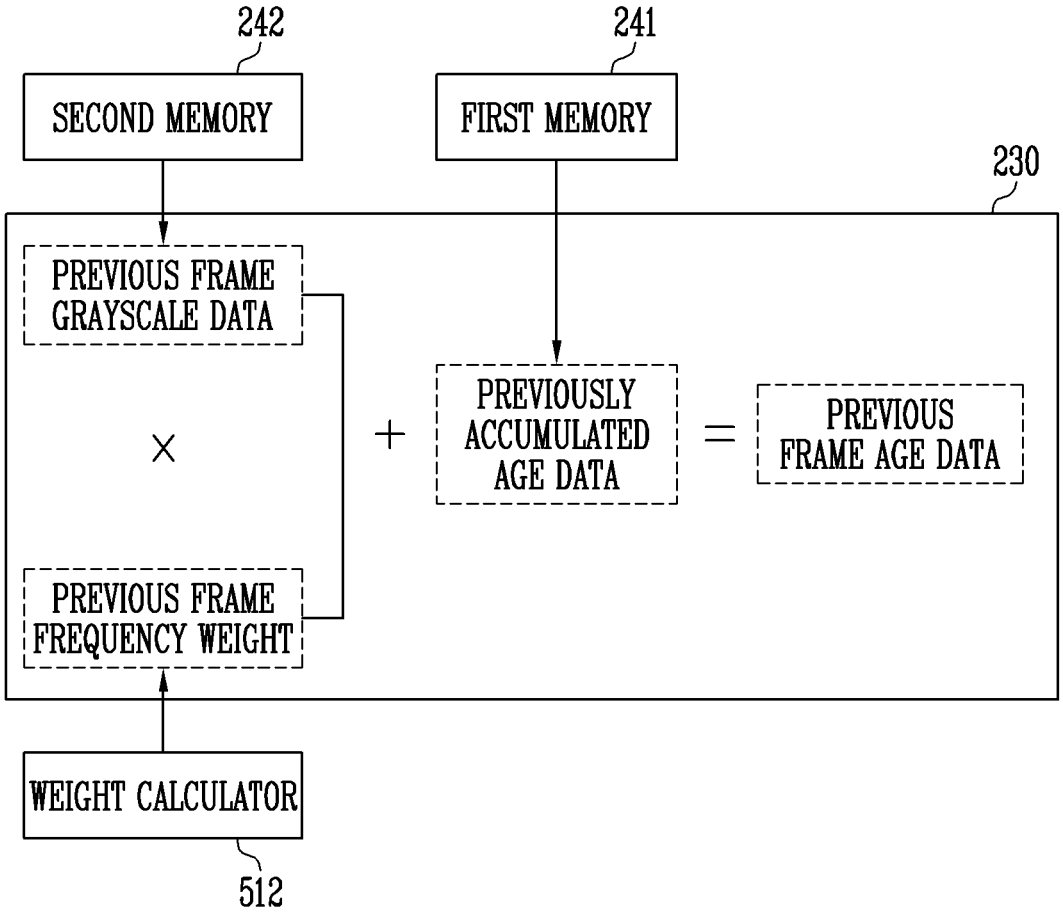
FIG. 7 is a block diagram illustrating an operation method of calculating age data by the image sticking compensator of the display device according to an embodiment.
Figure 8A:
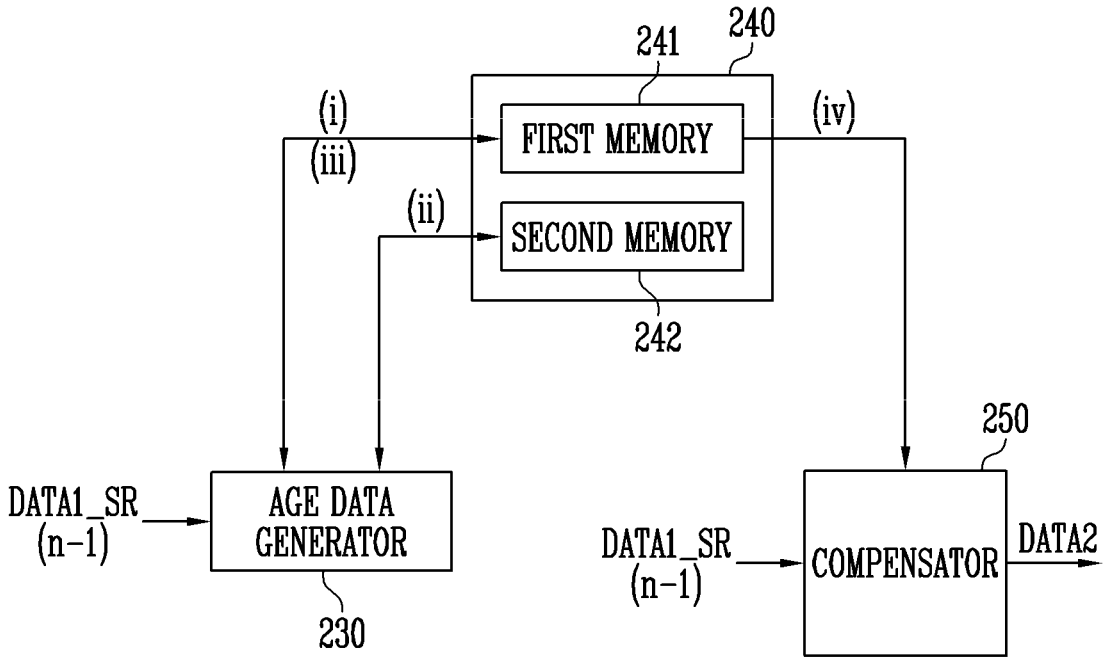
FIGS. 8A and 8B schematically illustrate a method of generating and applying the age data when scaled first image data of an (n-1)-th frame is input in the display device according to an embodiment.
Figure 8B:
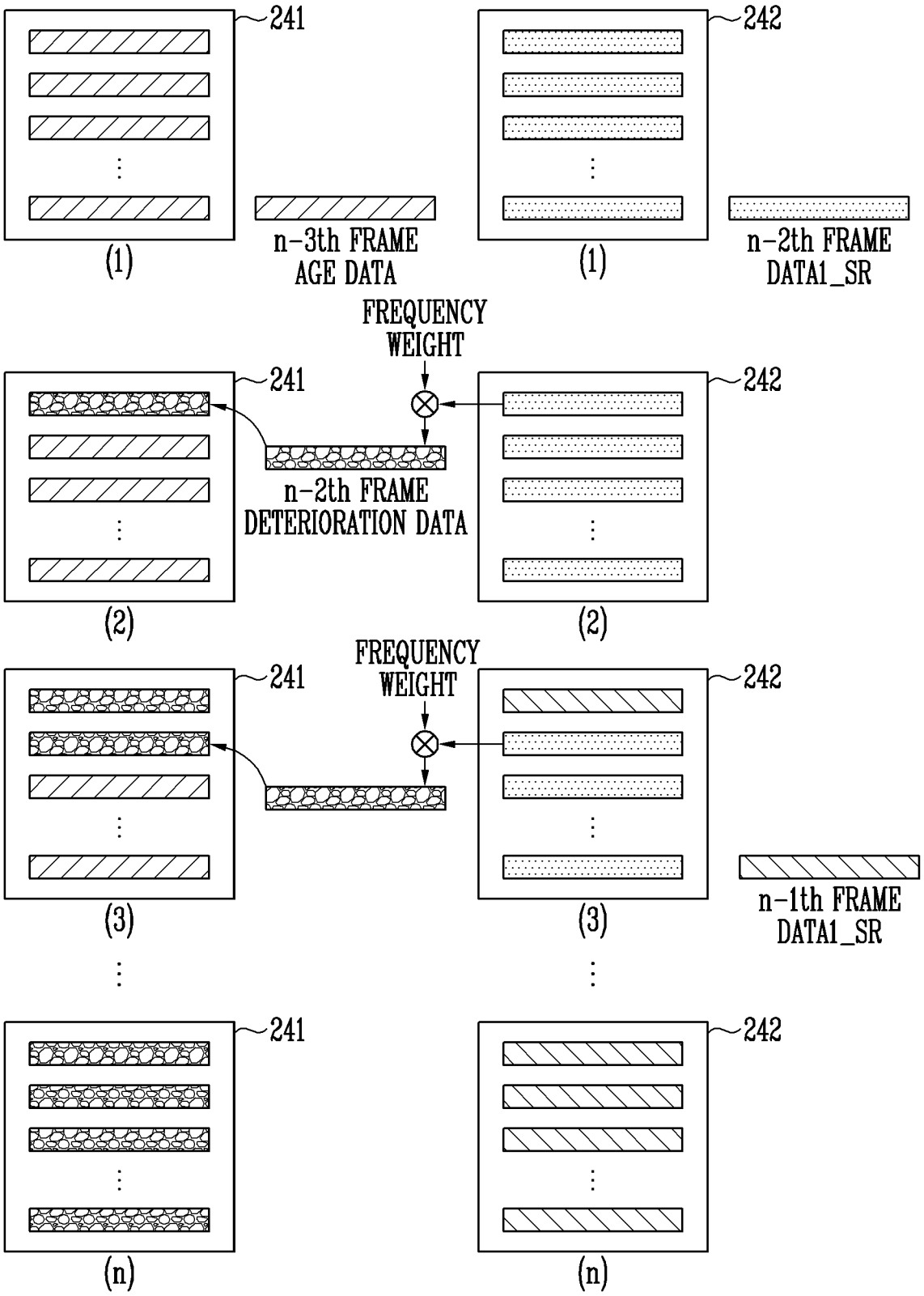
Figure 9A:
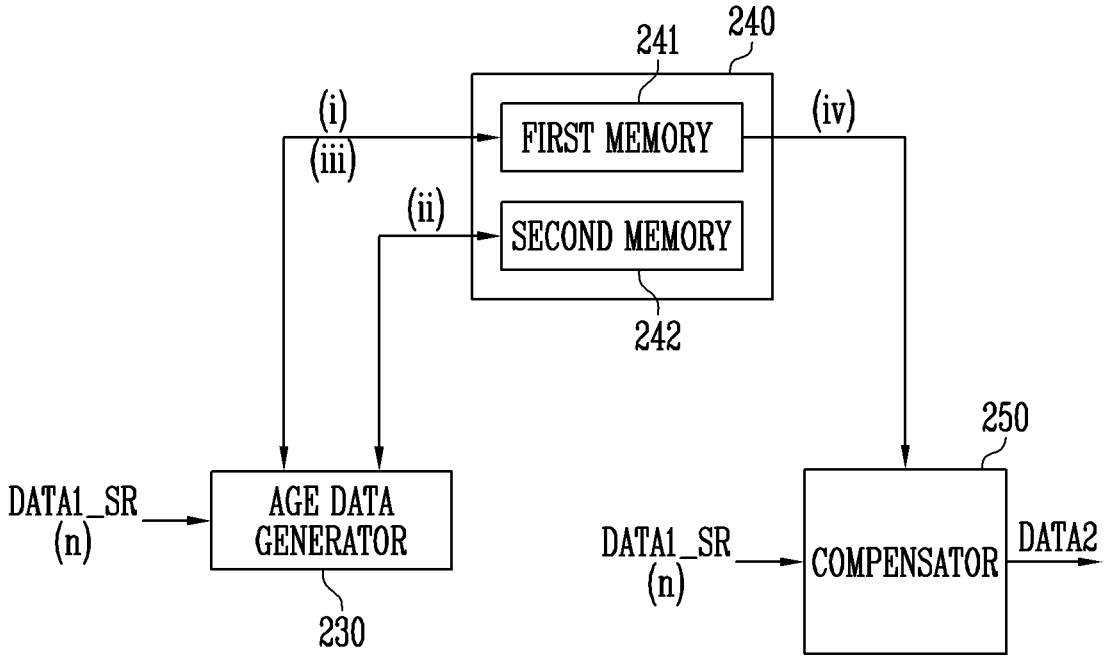
FIGS. 9A and 9B schematically illustrate a method of generating and applying the age data when scaled first image data of an nth frame is input in the display device according to an embodiment.
Figure 9B:
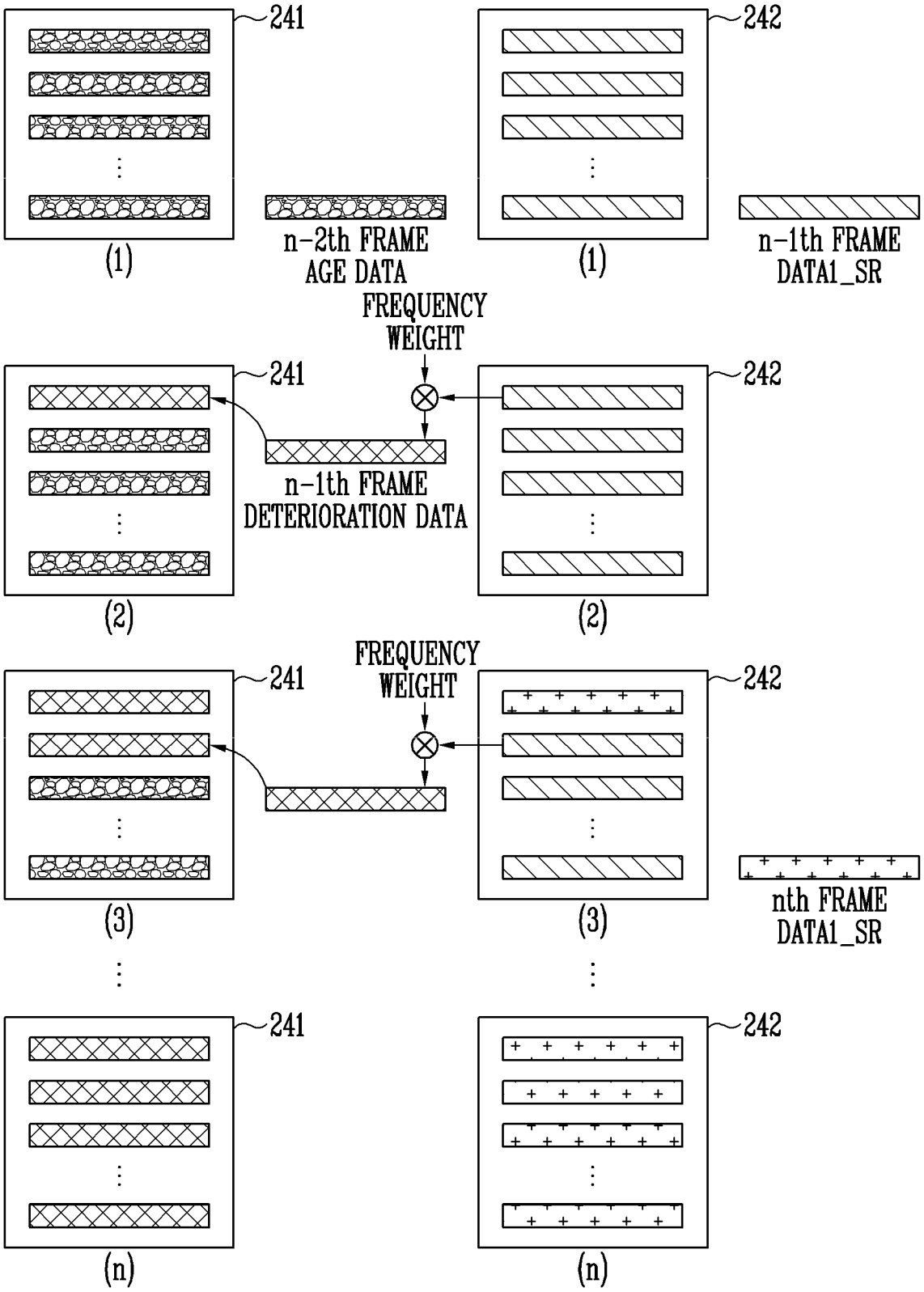

FIG. 5 is a block diagram illustrating the image sticking compensator of the display device according to an embodiment, FIG. 6 is a block diagram illustrating the memory of the image sticking compensator of the display device according to an embodiment, and FIG. 7 is a block diagram illustrating an operation method of calculating the age data by the image sticking compensator of the display device according to an embodiment. FIGS. 8A and 8B schematically illustrate a method of generating and applying the age data when the scaled first image data of an (n-1)-th frame is input in the display device according to an embodiment, and FIGS. 9A and 9B schematically illustrate a method of generating and applying the age data when the scaled first image data of an nth frame is input in the display device according to an embodiment.

First, referring to FIG. 5, the image sticking compensator 200 according to an embodiment includes a scaling ratio calculator 210, a luminance corrector 220, an age data generator 230, a memory 240, and a compensator 250.

The scaling ratio calculator 210 calculates a scaling ratio SR in order to control a luminance of the display panel 100 so that deterioration compensation can be achieved in the display panel 100. For example, in the display panel 100 divided into a*k (each of a and k is natural number of 1 or more) pixel blocks, the scaling ratio SR for scaling the first image data DATA1 may be calculated by reflecting maximum age data of the pixel block. The scaling ratio calculator 210 may receive a maximum value of the previously accumulated age data from the memory 240 to be described later, and reflect the maximum value in calculating the scaling ratio SR.

The luminance corrector 220 calculates the first image data DATA1 and the scaling ratio SR to generate the scaled first image data DATA1_SR, and provides the scaled first image data DATA1_SR to the age data generator 230 and the compensator 250 respectively.

In an embodiment, the luminance corrector 220 may generate the scaled first image data DATA1_SR by multiplying the first image data DATA1 and the scaling ratio SR, but according to an embodiment, a calculation method may be variously changed. In addition, when the accumulated age data is a large value, the luminance corrector 220 may down-scale the first image data DATA1 to provide optimally scaled first image data DATA1_SR to the entire area of the display panel 100.

The age data generator 230 generates the age data of the frame based on the scaled first image data DATA1_SR. The age data may be generated by accumulating deterioration data of one frame. Specifically, the age data generator 230 may calculate the age data by generating the deterioration data in a frame unit by reflecting a deterioration weight based on a panel condition or the like on the scaled first image data DATA1_SR, and accumulating the deterioration data of the frame unit. The panel condition may be at least one of a position of a pixel in the display panel 100, a size of an input grayscale, a current temperature of the display panel, and an emission duty of the pixel.

In addition, in an embodiment, the age data generator 230 may generate the deterioration data of one frame by additionally applying the frequency weight to grayscale data of one frame based on the scaled first image data DATA1_SR. Here, the frequency weight may be provided from the weight calculator 512 of the timing controller 500.

The age data generator 230 may accumulate the age data for each pixel or pixel block. For example, the pixel blocks may include 8*8 pixels. However, in another embodiment, the pixel blocks may include less than or larger than 8*8 pixels.

The age data generator 230 stores the scaled first image data DATA1_SR of the frame unit in the memory 240, and reflects the frequency or the like on the scaled first image data DATA1_SR stored in the memory 240 to generate the deterioration data. In addition, the age data generator 230 stores the generated deterioration data in the memory 240 so that the generated deterioration data is accumulated in the age data.

For example, when an image of an n-th frame is currently displayed, deterioration data up to an (n-2)-th frame may be accumulated and stored as the age data in the memory 240. (Actually, the age data is stored in the memory 240 in correspondence with a total use time of the pixels.)

The age data generator 230 may store the scaled first image data DATA1_SR of the (n-1)-th frame in a separate space of the memory 240 (or a separate memory). When the frequency weight is input from the weight calculator 512, the age data generator 230 may generate the deterioration data by reflecting the frequency weight or the like on the scaled first image data DATA1_SR of the (n-1)-th frame. The age data generator 230 may reflect the deterioration data to the previously accumulated age data and store age data in which the deterioration data is accumulated up to the (n-1)-th frame in the memory 240 again.

Referring to FIG. 6, the memory 240 includes a first memory 241 that stores the previously accumulated age data and a second memory 242 that stores the scaled first image data DATA1_SR of one frame.

The first memory 241 stores the age data of pixels accumulated from an initial use time of the display device 1 to the present. The age data stored in the first memory 241 may be updated in real time.

The scaled first image data DATA1_SR is stored in the second memory 242.

For example, in order to display an image of the current nth frame, the first memory 241 may store the age data accumulated up to the (n-2)-th frame, and the second memory 242 may store the scaled first image data DATA1_SR of the (n-1)-th frame.

The age data generator 230 may generate the accumulated age data by receiving the previously accumulated age data from the first memory 241 and receiving the scaled first image data DATA1_SR of one frame from the second memory 242. A detailed calculation method for generating the accumulated age data will be described below with reference to FIG. 7.

A method of generating the age data accumulated up to the previous frame by the age data generator 230 is as follows.

Referring to FIG. 7, the age data generator 230 may generate the age data accumulated up to the previous frame by multiplying the scaled first image data DATA1_SR of the previous frame by the frequency weight of the previous frame and adding the previously accumulated age data. Here, the scaled first image data DATA1_SR of the previous frame may be provided from the second memory 242, and the previously accumulated age data may be provided from the first memory 241. In addition, the frequency weight may be provided from the weight calculator 512. According to an embodiment, the calculation method of the age data generator 230 may be variously changed.

The age data accumulated up to the previous frame generated by the age data generator 230 may be stored in the first memory 241. The first memory 241 may update the previously accumulated age data. In addition, the first memory 241 may provide the maximum value of the previously accumulated age data to the scaling ratio calculator 210.

That is, the age data generator 230 may update the age data accumulated up to the previous frame in the memory 240. The age data generator 230 may update the age data using the first memory 241 and the second memory 242 whenever the frame is changed. Accordingly, the first memory 241 may include the updated accumulated age data, and the second memory 242 may include the updated scaled first image data DATA1_SR of one frame.

A method of updating the age data generated by the age data generator 230 in the memory 240 will be described below with reference to FIGS. 8A, 8B, 9A, and 9B.

First, referring to FIGS. 8A and 8B, before scaled first image data DATA1_SR(n-1) of an (n-1)-th frame is input to the age data generator 230, age data reflected up to an (n-3)-th frame are stored in the first memory 241 (step (i) of FIG. 8A).

In addition, before the scaled first image data DATA1_SR (n-1) of the (n-1)-th frame is input to the age data generator 230, scaled first image data DATA1_SR of an (n-2)-th frame is stored in the second memory 242 (step (ii) of FIG. 8A).

For example, in FIG. 8B, the age data reflected up to the (n-3)-th frame in a predetermined pixel block unit may be stored in the first memory 241 shown as (1) at a lower end, and the scaled first image data DATA1_SR of the (n-2)-th frame may be stored in the second memory 242 shown as (1) at the lower end.

After the scaled first image data DATA1_SR of the (n-2)-th frame is stored in the second memory 242 (step (ii) of FIG. 8A), the age data generator 230 receives a frequency weight of the (n-2)-th frame and receives the scaled first image data DATA1_SR of the (n-2)-th frame from the second memory 242.

As shown in FIG. 8B, the age data generator 230 receiving the frequency weight generates deterioration data of the (n-2)-th frame by reflecting the frequency weight of the (n-2)-th frame on some data (for example, data stored the longest in the second memory 242) among the scaled first image data DATA1_SR stored in the second memory 242, and generates the age data accumulated up to the (n-2)-th frame by accumulating the generated deterioration data in the first memory 241.

The age data generator 230 updates the deterioration data of the (n-2)-th frame in the first memory 241 (step (iii) of FIG. 8A). Therefore, as shown in FIG. 8B, the deterioration data of the (n-2)-th frame is stored in the first memory 241 shown as (2) at the lower end.

In addition, the age data generator 230 stores the scaled first image data DATA1_SR(n-1) of the (n-1)-th frame in the pixel block in which the deterioration data of the second memory 242 is generated. In FIG. 8B, the scaled first image data DATA1_SR of the (n-1)-th frame is stored in the second memory 242 shown as (3) at the lower end.

That is, the age data generator 230 generates the deterioration data of the (n-2)-th frame by sequentially reflecting the frequency weight of the (n-2)-th frame on the scaled first image data DATA1_SR of the (n-2)-th frame stored in the second memory 242, and generate age data of the (n-2)-th frame by accumulating the generated deterioration data in the first memory 241. In addition, the age data generator 230 sequentially stores the scaled first image data DATA1_SR of the (n-1)-th frame in the second memory 242.

In FIG. 8B, the age data accumulated up to the (n-2)-th frame is stored in the first memory 241 shown as (n) at the lower end, and the scaled first image data DATA1_SR(n) of the (n-1)-th frame is stored in the second memory 242.

The compensator 250 receives the scaled first image data DATA1_SR(n-1) of the (n-1)-th frame (step (iv) of FIG. 8A). The compensator 250 receiving the scaled first image data DATA1_SR(n-1) of the (n-1)-th frame outputs the second image data using the age data accumulated in the first memory 241, that is, the age data accumulated up to the (n-2)-th frame.

Referring to FIGS. 9A and 9B, before the scaled first image data DATA1_SR(n) of the nth frame is input to the age data generator 230, the age data accumulated up to the (n-2)-th frame is stored in the first memory 241 (step (i) of FIG. 9A), In addition, before the scaled first image data DATA1_SR(n) of the nth frame is input to the age data generator 230, the scaled first image data DATA1_SR of the (n-1)-th frame is stored in the second memory 242 (step (i) of FIG. 9A).

For example, in FIG. 9B, the age data accumulated up to the (n-2)-th frame may be stored in the first memory 241 in a predetermined pixel block unit shown as (1) at a lower end, and the scaled first image data DATA1_SR of the (n-1)-th frame may be stored in a predetermined pixel block unit.

After the scaled first image data DATA1_SR of the (n-1)-th frame is stored in the second memory 242 (step (ii) in FIG. 9A), the age data generator 230 receives a frequency weight of the (n-1)-th frame from the weight calculator 512 and the scaled first image data DATA1_SR of the (n-1)-th frame from the second memory 242.

As shown in FIG. 9B, the age data generator 230 receiving the frequency weight generates deterioration data of the (n-1)-th frame by reflecting the frequency weight of the (n-1)-th frame on some data among the scaled first image data DATA1_SR stored in the second memory 242, and generates the age data accumulated up to the (n-1)-th frame by accumulating the generated deterioration data in the first memory 241. The age data generator 230 updates the deterioration data of the (n-1)-th frame in the first memory 241 (step (iii) of FIG. 9A). Therefore, as shown in FIG. 9B, the deterioration data of the (n-2)-th frame is stored in the first memory 241 shown as (2) at the lower end.

In addition, the age data generator 230 stores the scaled first image data DATA1_SR(n) of the nth frame in the pixel block in which the deterioration data of the second memory 242 is generated. In FIG. 8B, the scaled first image data DATA1_SR(n) of the nth frame is stored in the second memory 242 shown as (3) at the lower end.

That is, the age data generator 230 generates the deterioration data of the (n-1)-th frame by sequentially reflecting the frequency weight on the scaled first image data DATA1_SR of the (n-1)-th frame stored in the second memory 242, and generate age data of the (n-1)-th frame by accumulating the generated deterioration data in the first memory 241. In addition, the age data generator 230 sequentially stores the scaled first image data DATA1_SR(n) of the nth frame in the second memory 242.

In FIG. 9B, the age data accumulated up to the (n-1)-th frame is stored in the first memory 241 shown as (n) at the lower end, and the scaled first image data DATA1_SR(n) of the nth frame is stored in the second memory 242.

The compensator 250 receives the scaled first image data DATA1_SR(n) of the nth frame (step (iv) of FIG. 9A). The compensator 250 receiving the scaled first image data DATA1_SR(n) of the nth frame outputs the second image data using the age data accumulated in the first memory 241, that is, the age data accumulated up to the (n-1)-th frame.

The compensator 250 may include a plurality of lookup tables LUTs (not shown) in which a plurality of preset age values corresponding to the age data and compensation values corresponding to respective display grayscales that may be implemented by the display panel are set. The second image data DATA2 may be determined based on the lookup table LUT.

The second image data DATA2 may have a digital format defined as a grayscale domain. In addition, the second image data DATA2 may be converted into an analog format in which a voltage domain to be provided to the display panel 100 is defined through a gamma corrector (not shown) that is separately provided.

As described above, since the display device according to an embodiment may separately store the scaled image data of the previous frame and reflect the frequency weight according to the driving frequency of the previous frame to generate the age data accumulated up to the previous frame, the display device may compensate for deterioration of a light emitting element by reflecting a change of the frequency of the frame in real time, and the display device in which an image sticking is improved may be provided.

Hereinafter, deterioration data of a case where different frequencies are applied to a plurality of frames will be described with reference to FIG. 10.

Figure 10A:
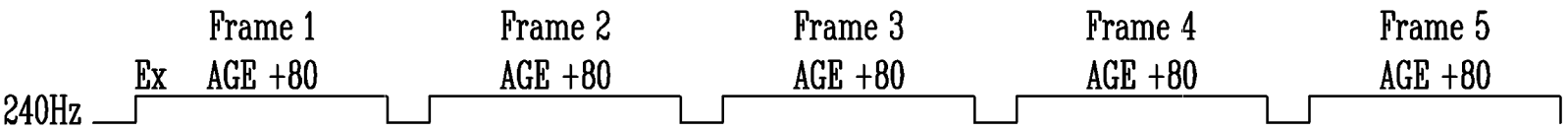
FIGS. 10A and 10B are a schematic diagram illustrating deterioration data accumulated in a frame according to an applied frequency in the display device according to an embodiment.
Figure 10B:
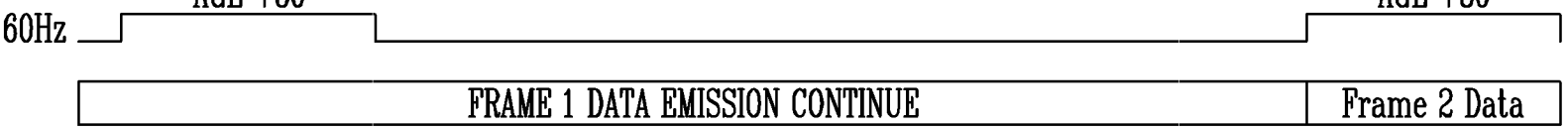

FIGS. 10A and 10B are a schematic diagram illustrating the deterioration data of the frame according to the applied frequency in the display device according to an embodiment.

Referring to a signal shown in FIG. 10A, in frequency mode, a signal of 240 Hz may be applied to the plurality of frames, and deterioration data according to input image data may be generated for each frame. Here, the input image data may be the scaled first image data DATA1_SR described above. For example, when deterioration data of 80 is generated for each frame, deterioration data may be accumulated up to first to fourth frames Frame 1, Frame 2, Frame 3, and Frame 4, and thus age data of 320 may be generated. That is, when the driving frequency is 240 Hz, after one period elapses, the age data of 320 may be reflected on the input image data to generate compensation data. Here, the compensation data may be the second image data DATA2 described above.

On the other hand, referring to a signal shown in FIG. 10B, in frequency mode, a signal of 60 Hz may be applied to the plurality of frames, and deterioration data according to input image data may be generated for each frame. For example, when deterioration data of 80 is generated for each frame, age data of 80 may be generated during one frame period (the first to fourth frames of 60 Hz). That is, when the driving frequency is 60 Hz, after one period elapses, the age data of 80 may be accumulated.

Therefore, when the frequency applied to each frame in the display device is different, the age data of the display panel may be different.

In the display device according to an embodiment, a frequency may be set differently for each frame. For example, a signal of 240 Hz may be applied in first to fifth frames Frame 1, Frame 2, Frame 3, Frame 4, and Frame 5, and a signal of 60 Hz may be applied in sixth to tenth frames Frame 6, Frame 7, Frame 8, Frame 9, and Frame 10 (not shown). When a basic frequency of the display device is 240 Hz, the memory may store the age data by accumulating the deterioration data according to the input image data at the basic frequency. However, in a display device according to a comparative example, even though the frequency applied to the display device is changed, the changed frequency is not reflected on the memory, and the deterioration data according to the input image data is accumulated to store the age data. Thus, the age data according to actual light emission of the display panel and the age data stored in the memory may be different. That is, when the frequency of the display device is changed, a problem that the age data according to the frequency change is not properly reflected may occur.

The display device according to an embodiment may separately store the scaled image data of the previous frame and reflect the deterioration weight according to the driving frequency of the previous frame to generate the age data. Therefore, the display device may compensate for deterioration of the light emitting element and the display device in which the image sticking is improved may be provided.

Hereinafter, a method of driving the display device according to an embodiment will be described with reference to FIG. 11.

Figure 11:
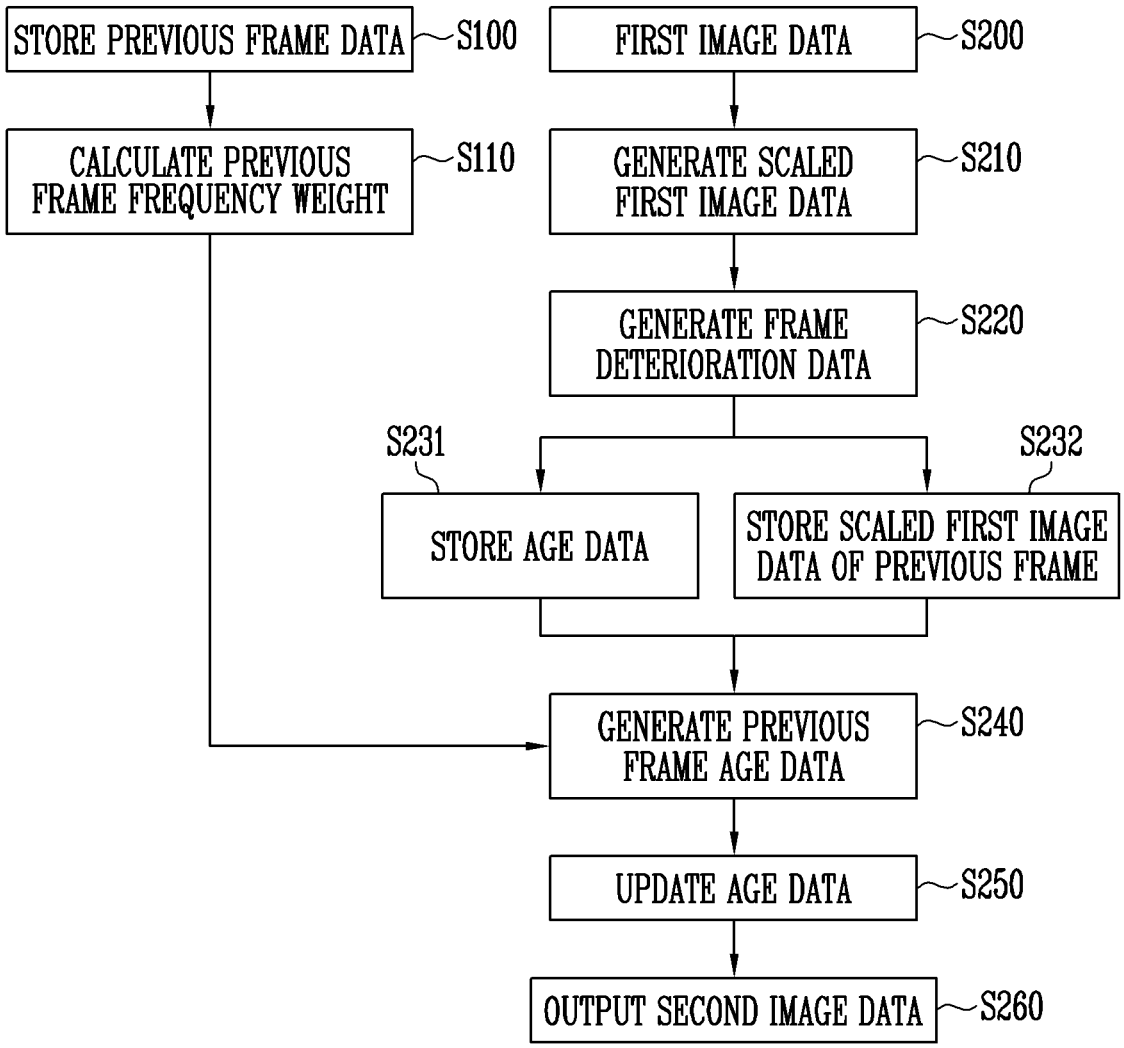
FIG. 11 is a flowchart illustrating a method of driving the display device according to an embodiment.

FIG. 11 is a flowchart illustrating the method of driving the display device according to an embodiment.

In FIG. 11, the same reference numerals are written as those shown in FIGS. 1, 2, 3, 4, 5, 6, 7, 8A, 8B, 9A, and 9B with reference to FIGS. 1, 2, 3, 4, 5, 6, 7, 8A, 8B, 9A, and 9B described above.

In the display device according to an embodiment, the frame frequency may be varied in at least one frame unit. After the data of the previous frame is stored in the memory 240 (S100), the timing controller 500 calculates the weight for the frequency of the previous frame (S110). The frequency determiner 511 of the timing controller 500 may determine the frequency after the data of the previous frame is stored in the second memory 242, and the weight calculator 512 may calculate the frequency weight by reflecting the determined frequency. The weight calculator 512 may provide the calculated frequency weight to the age data generator 230 for calculation of the age data.

The image sticking compensator 200 receives the first image data DATA1 from the outside (S200). The luminance corrector 220 of the image sticking compensator 200 may receive the first image data DATA1.

Thereafter, the luminance corrector 220 generates the scaled first image data DATA1_SR by reflecting the scaling ratio SR for correcting a luminance of the first image data DATA1 (S210). The luminance corrector 220 may generate the scaled first image data DATA1_SR by multiplying the first image data DATA1 by the scaling ratio SR.

Thereafter, the age data generator 230 generates the deterioration data of the frame based on the scaled first image data DATA1_SR (S220). The age data generator 230 may generate the deterioration data by reflecting the deterioration weight on the scaled first image data DATA1_SR of each frame, and generate the age data by accumulating the deterioration data of a frame unit. The deterioration weight may include the frequency weight, and may additionally include at least one of the positions of the pixel, the size of the input grayscale, the current temperature of the display panel, and the emission duty of the pixel. Here, the frequency weight may be provided from the weight calculator 512.

Thereafter, the age data generator 230 stores the age data in the memory 240.

The age data is accumulated and stored in the first memory 241 (S231), and the scaled first image data DATA1_SR of the previous frame is stored in the second memory 242 (S232). For example, when the image of the current n-th frame is displayed, the deterioration data up to the (n-2)-th frame may be accumulated and stored in the first memory 241, and the scaled first image data DATA1_SR of the (n-1)-th frame may be stored in the second memory 242.

The age data generator 230 generates the age data accumulated up to the previous frame (S240). The age data generator 230 may generate the deterioration data by reflecting the frequency weight on the scaled first image data DATA1_SR of the previous frame of the second memory 242, and generate the age data accumulated up to the previous frame by reflecting the deterioration data of the previous frame on the previously accumulated age data.

The age data generator 230 may update the age data accumulated up to the previous frame in the first memory 241 again (S250). In addition, the first memory 241 may provide the age data accumulated up to the previous frame to the compensator 250.

Thereafter, the compensator 250 outputs the second image data DATA2 based on the age data accumulated up to the previous frame and the scaled first image data DATA1_SR (S260).

Although the disclosure has been described with reference to the preferred embodiment above, those skilled in the art or those having a common knowledge in the art will understand that the disclosure may be variously modified and changed without departing from the spirit and technical area of the disclosure described in the claims which will be described later.

Therefore, the technical scope of the disclosure should not be limited to the contents described in the detailed description of the specification, but should be defined by the claims.

What is claimed is:

1. A display device comprising:

a display panel including a plurality of pixels;

a timing controller configured to receive a first image data and a data enable signal of a present frame from an external source; and an image sticking compensator configured to generate a second image data by reflecting an age data accumulated in the first image data, wherein the image sticking compensator generates the age data by reflecting a frequency weight corresponding to a frequency of a previous frame to an image data of the previous frame after the image data of the previous frame is stored, and generates a deterioration data of the previous frame by reflecting the frequency weight of the previous frame, wherein the timing controller determines the frequency of the previous frame before the data enable signal of the present frame is applied to the timing controller, and calculates the frequency weight of the previous frame by reflecting the frequency of the previous frame, wherein the image sticking compensator updates the age data by reflecting the deterioration data, and wherein the timing controller provides the data enable signal of the present frame to the image sticking compensator after the age data is updated.

2. The display device according to claim 1, wherein the image data of the previous frame is a scaled first image data provided to the previous frame.

3. The display device according to claim 2, further comprising:

a gate driver configured to provide a scan signal to the display panel through a plurality of gate lines;

a data driver configured to provide a data signal corresponding to the second image data to the display panel through a plurality of data lines; and the timing controller configured to control driving of the gate driver and the data driver.

4. The display device according to claim 3, wherein the image sticking compensator includes a scaling ratio calculator configured to calculate a scaling ratio of the display panel.

5. The display device according to claim 4, wherein the image sticking compensator generates the scaled first image data by calculating the scaling ratio and the first image data.

6. The display device according to claim 5, wherein the image sticking compensator comprises:

an age data generator configured to generate the age data based on the scaled first image data; and a memory configured to store the updated age data and image data of the previous frame.

7. The display device according to claim 6, wherein the memory comprises:

a first memory configured to store the updated age data; and a second memory configured to store the image data of the previous frame.

8. The display device according to claim 7, wherein the age data generator generates the deterioration data by multiplying the image data of the previous frame by the frequency weight, and generates the age data accumulated up to the previous frame by reflecting the updated age data on the deterioration data.

9. The display device according to claim 8, wherein the image sticking compensator outputs the second image data based on the age data which is accumulated up to the previous frame and the scaled first image data.

10. A display device comprising:

a display panel including a plurality of pixels;

a timing controller configured to receive a first image data and a data enable signal of a present frame from an external source;

a scaling ratio calculator configured to calculate a scaling ratio of the display panel;

a luminance corrector configured to generate a scaled first image data by calculating the first image data and the scaling ratio;

an age data generator configured to generate an age data based on the scaled first image data;

a memory configured to store the age data and the scaled first image data of a previous frame;

a compensator configured to output a second image data based on the scaled first image data and the age data;

a gate driver configured to provide a scan signal to the display panel through a plurality of gate lines;

a data driver configured to provide a data signal corresponding to the second image data to the display panel through a plurality of data lines; and a timing controller configured to control driving of the gate driver and the data driver, wherein the age data generator generates the age data accumulated up to the previous frame by reflecting a frequency weight is applied to a grayscale data of one frame based on the scaled first image data, and a previously accumulated age data, and generates a deterioration data of the previous frame by reflecting the frequency weight of the previous frame, wherein the timing controller determines a frequency of the previous frame before the data enable signal of the present frame is applied to the timing controller, and calculates the frequency weight of the previous frame by reflecting the frequency of the previous frame, wherein the age data generator updates the age data by reflecting the deterioration data up to the previous frame, and wherein the timing controller provides the data enable signal of the present frame to the age data generator after the age data is updated.

11. The display device according to claim 10, wherein the memory comprises:

a first memory configured to store the previously accumulated age data; and a second memory configured to store the scaled first image data.

12. The display device according to claim 11, wherein the previously accumulated age data is the age data accumulated up to a previous frame of the previous frame.

13. The display device according to claim 12, wherein the age data generator generates the deterioration data by multiplying the scaled first image data of the one frame by the frequency weight, and generates the age data accumulated up to the previous frame by reflecting the previously accumulated age data to the deterioration data.

14. The display device according to claim 13, wherein the compensator outputs the second image data based on the age data accumulated up to the previous frame and the scaled first image data.

15. A method of driving a display device, the method comprising steps:

determining a frequency after data of a previous frame is stored;

calculating a frequency weight based on the frequency;

receiving a first image data;

generating a scaled first image data by reflecting a scaling ratio on the first image data;

generating a frame deterioration data by reflecting a frequency weight of the previous frame corresponding to a frequency of the previous frame based on the scaled first image data; and storing an age data by reflecting the frequency weight, and distinguishing and storing the scaled first image data of the previous frame, wherein the timing controller determines the frequency of the previous frame before a data enable signal of a present frame is applied to the timing controller, and calculates the frequency weight of the previous frame by reflecting the frequency of the previous frame, wherein the age data generator updates the age data by reflecting the frame deterioration data, and wherein the timing controller provides the data enable signal of the present frame to the age data generator after the age data is updated.

16. The method according to claim 15, further comprising a step of:

generating an age data which is accumulated up to the previous frame based on the frequency weight, the scaled first image data of the previous frame, and the accumulated age data.

17. The method according to claim 16, wherein the accumulated age data is an age data which is accumulated up to a previous frame of the previous frame.

18. The method according to claim 17, wherein a second image data is output based on the scaled first image data and the age data up to the previous frame.

* * * * *